US009842572B2

(12) United States Patent
Ryan

(10) Patent No.: US 9,842,572 B2
(45) Date of Patent: Dec. 12, 2017

(54) METHODS AND APPARATUS FOR DISPLAYING VIDEO INCLUDING VARIABLE FRAME RATES

(71) Applicant: Texas Instruments Incorporated, Dallas, TX (US)

(72) Inventor: Timothy L. Ryan, Celina, TX (US)

(73) Assignee: TEXAS INSTRUMENTS INCORPORATED, Dallas, TX (US)

( * ) Notice: Subject to any disclaimer, the term of this patent is extended or adjusted under 35 U.S.C. 154(b) by 343 days.

(21) Appl. No.: 14/587,973

(22) Filed: Dec. 31, 2014

(65) Prior Publication Data

US 2016/0189685 A1 Jun. 30, 2016

(51) Int. Cl.

| | |
|---|---|
| ***G09G 5/12*** | (2006.01) |
| ***G09G 5/36*** | (2006.01) |
| ***G09G 5/00*** | (2006.01) |

(52) U.S. Cl.

CPC ..... *G09G 5/36* (2013.01); *G09G 5/003* (2013.01); *G09G 5/12* (2013.01); *G09G 2340/0435* (2013.01); *G09G 2360/18* (2013.01); *G09G 2370/04* (2013.01)

(58) Field of Classification Search

CPC ..... G06T 1/20; G09G 2340/0435; G09G 2360/18

See application file for complete search history.

(56) References Cited

U.S. PATENT DOCUMENTS

| | | | | |
|---|---|---|---|---|
| 7,508,449 | B1 * | 3/2009 | Greenberg | H04N 7/0112 348/447 |
| 2011/0018881 | A1 | 1/2011 | Nash | |
| 2013/0257752 | A1 | 10/2013 | Tripathi et al. | |
| 2015/0264298 | A1 * | 9/2015 | Colenbrander | H04N 7/013 345/547 |
| 2016/0155399 | A1 * | 6/2016 | Tripathi | G09G 3/3614 345/506 |

* cited by examiner

*Primary Examiner* — Jacinta M Crawford

(74) *Attorney, Agent, or Firm* — Michael A. Davis, Jr.; Charles A. Brill; Frank D. Cimino

(57) ABSTRACT

Methods are described for displaying video including variable frame rates. A method for displaying images includes receiving digital video data including video image data in a display system capable of displaying images at multiple frame rates; storing the digital video data in at least one frame buffer coupled to the display system; receiving in the digital video data ancillary data comprising at least configuration parameters indicating a current frame rate and a future frame rate; storing the parameters representative of a current frame rate in a first timing control buffer coupled to the display system; storing the parameters representative of a future frame rate in a second timing control buffer; displaying images from data in the frame buffer at the current frame rate; and upon detection of a swap condition, instantly displaying images from data in the frame buffer at the future frame rate. Additional methods and apparatus are described.

16 Claims, 3 Drawing Sheets

METHODS AND APPARATUS FOR DISPLAYING VIDEO INCLUDING VARIABLE FRAME RATES

TECHNICAL FIELD

Aspects of the present application relate generally to the field of directly displaying variable frame rate digital video content without the viewer noticing image artifacts from the frame rate changes.

BACKGROUND

Frame Rate (FR) is a term used in the video industry to indicate how many images (or frames) are displayed per second. The FR is independent of and different from the resolution of the images.

Produced Content refers to content that has been edited and/or assembled from raw video captures into a digital data stream. The editing may occur "real time" as in the example of a football game being filmed with multiple cameras around a stadium, then assembled in real time with the audience viewing the Produced Content. The sources edited or assembled can include recorded sports action, commercials, interviews, etc. Another example is the editing of a cinema movie where various scenes are filmed across many months, then brought together, edited and then post processed into a final Produced Content.

The Society of Motion Picture and Television Engineers (SMPTE) is a consortium of professionals in the video field that create and maintain standards by which various video formats are created, encoded, transported and stored. Formatting of Ancillary (ANC) video information is covered in standard 291M. In the standard, ANC video information can be transmitted within the video data.

Traditionally, cinema camera frame rates captured data at 24 frames per second (fps). Advances in technology have enabled higher frame rates, such as without limitation 48, 60, 96 and 120 fps to suit specific content. Future systems are expected to produce higher frame rates such as 240 and 300 fps. Higher frame rates are used to capture quick moving events and make for a higher quality viewing experience because quick movement in the video Produced Content appear smoother and with less blur to the viewer (when compared to video produced at slower frame rates).

The use of higher frame rates comes at a cost of larger data storage size and higher bandwidth for transmission. For that reason, it is desirable to only use the higher frame rates where the content dictates it, reverting back to lower frame rates where appropriate. Content of this type is called variable frame rate (VFR) and the capability of producing it exists.

However, as currently implemented, the ability to directly display variable frame rate content in a display system without visual artifacts due to the rate changes does not exist. In prior known systems, visible artifacts are created when the frame rate dynamically changes because of the time duration it takes for the display device to comprehend the new frame rate, synchronize to the new data arrival rate and then finally begin to correctly produce the image. This problem is equally applicable to motion pictures, television, web, or any display of produced video content.

In cases where displaying variable frame rate video content is desired, one prior known approach is to mask the visible artifacts caused by frame rate transitions from view by inserting dummy or black frames into the video stream so that the artifacts are less likely to be visible to the viewer while the display re-synchronizes to the new frame rate. The dummy or black frames presented to the viewer may be noticed, making use of this approach undesirable especially in cinema and sports applications.

In another case, an additional processor may be employed within the video display to convert variable frame rate data into a single frame rate data. The additional processor approach has drawbacks as well. In addition to the extra cost, the conversion necessitates some interpolation of the video frames which the viewer may notice and the displayed images may differ from the original content. The original producer of the Produced Content has no control over the way the video is displayed by the system in these known approaches.

FIG. 1 depicts a block diagram of a conventional video display system. In FIG. 1, in system 100, digital video data 110 is provided to a digital video display system 120. Within the digital video display system 120, the digital video data 110 is received by video processing logic 130. Part of the video processing logic 130 is a frame rate detection block 122. The frame rate detection block 122 is coupled to a processor 128. The processor 128 has access to data used for proper timing by the Display Hardware 140 and updates this data in registers or by other means indicated by a Timing Configuration Buffer (TCB) 124. In operation, the video processing block 130 receives digital video data 110 and stores the image data into a frame buffer 126. The frame rate detection block 122 updates the processor 128 with the frame rate. The processor 128 updates parameters in the TCB 124 which enables the display hardware 140 to display the frames of digital video data 110 with the correct timing. In a typical system, when the frame rate changes, it may take many frames for the parameters in the TCB 124 to be fully updated. During that period, the system may produce visual artifacts which the viewer can deem undesirable. The visual artifacts result from displaying video images using an incorrect frame rate.

The prior known solutions cannot directly display variable frame rate video data without visible artifacts in the displayed image. Improvements in the direct display of video Produced Content including variable frame rates are therefore needed in order to address the deficiencies and the disadvantages of the prior known approaches. Solutions are needed that allow direct display of the VFR video content which eliminate or reduce the visual artifacts that exist in prior known solutions.

SUMMARY

Aspects of this application provide methods for producing a Variable Frame Rate (VFR) video stream with embedded frame rate data. Other aspects of this application disclose methods and apparatus that enable a video device to directly display the VFR video stream with reduced visual artifacts or free from visual artifacts.

In an aspect of the present application, an apparatus for image display includes: at least one display system for displaying images from image data retrieved from a frame buffer at a variety of frame rates; a first timing control buffer coupled to the at least one display system configured to store parameters needed to display images at a current frame rate; a second timing control buffer coupled to the at least one display configured to store parameters needed to display images at a future frame rate; a video processing logic coupled to receive digital video data for display at a video data input, and configured for storing image data corresponding to the digital video data in the frame buffer;

wherein the video processing logic is further configured to receive ancillary data in the digital video data received, the ancillary data comprising at least a current frame rate, and a future frame rate.

In another aspect of the present application, a method for displaying images includes receiving digital video data including video image data in a display system capable of displaying images at multiple frame rates; storing the digital video data in at least one frame buffer coupled to the display system; receiving in the digital video data ancillary data comprising at least configuration parameters indicating a current frame rate and a future frame rate; storing parameters indicating a current frame rate in a first timing control buffer coupled to the display system; storing the parameters indicating a future frame rate in a second timing control buffer coupled to the display system; using the display system, displaying images from data in the frame buffer at the current frame rate; and upon detection of a swap condition, using the display system to instantly display images from data in the frame buffer at the future frame rate.

In a further aspect of the present application, a method of producing video content includes recording video images using variable frame rates for different portions of the video images while recording, and outputting digital video data corresponding to the recorded video images; finding within the digital video data the positions of frames corresponding to changes in the frame rate that occurred during recording of the video images; producing current frame rate and future frame rate information for the frames in the digital video data, the current frame rate indicating a frame rate for use in displaying the current video frame, the future frame rate indicating a frame rate for use in displaying future video frames; and embedding in selected ones of the frames in the digital video data the current frame rate and the future frame rate.

Recognition is made in aspects of the present application that direct display of video content including variable frame rate images can be accomplished by receiving current frame and future frame information in digital video data, storing timing control information corresponding to the current and future frame rate, and swapping to instantly display image using the future frame rate on detection of a frame rate boundary.

BRIEF DESCRIPTION OF THE DRAWINGS

For a more complete understanding of the illustrative examples of aspects of the present application that are described herein and the advantages thereof, reference is now made to the following descriptions taken in conjunction with the accompanying drawings, in which.

Corresponding numerals and symbols in the different figures generally refer to corresponding parts unless otherwise indicated. The figures are drawn to clearly illustrate the relevant aspects of the illustrative example arrangements and are not necessarily drawn to scale.

DETAILED DESCRIPTION

The making and using of various example illustrative arrangements that incorporate aspects of the present application are discussed in detail below. It should be appreciated, however, that the illustrative examples disclosed provide many applicable inventive concepts that can be embodied in a wide variety of specific contexts. The specific examples and arrangements discussed are merely illustrative of specific ways to make and use the various arrangements, and the examples described do not limit the scope of the specification, nor do they limit the scope of the appended claims.

For example, when the term "coupled" is used herein to describe the relationships between elements, the term as used in the specification and the appended claims is to be interpreted broadly, and while the term "coupled" includes "connected", the term "coupled" is not to be limited to "connected" or "directly connected" but instead the term "coupled" may include connections made with intervening elements, and additional elements and various connections may be used between any elements that are described as "coupled."

Aspects of the present application provide methods for creating Variable Frame Rate (VFR) Produced Content with current and future frame rates encoded in the content. Other aspects of this application disclose methods that enable a video display device to directly display the VFR video stream at multiple frame rates while eliminating or reducing visual artifacts. Additional aspects include apparatus arrangements to implement the methods for directly displaying variable frame rate video content with reduced or free from visual artifacts.

Figure 1:
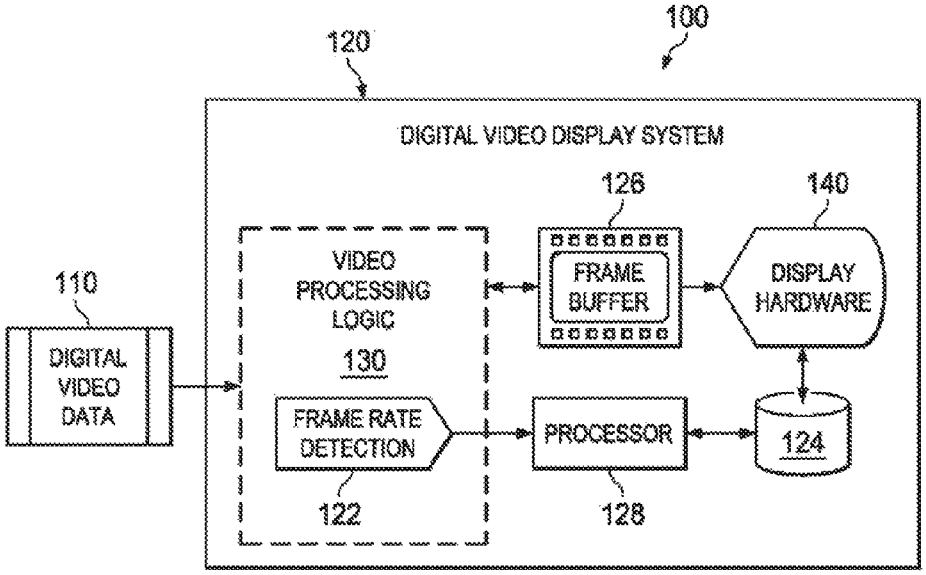
FIG. 1 (PRIOR ART)
FIG. 1 depicts a block diagram of a conventional video display system.
Figure 2:
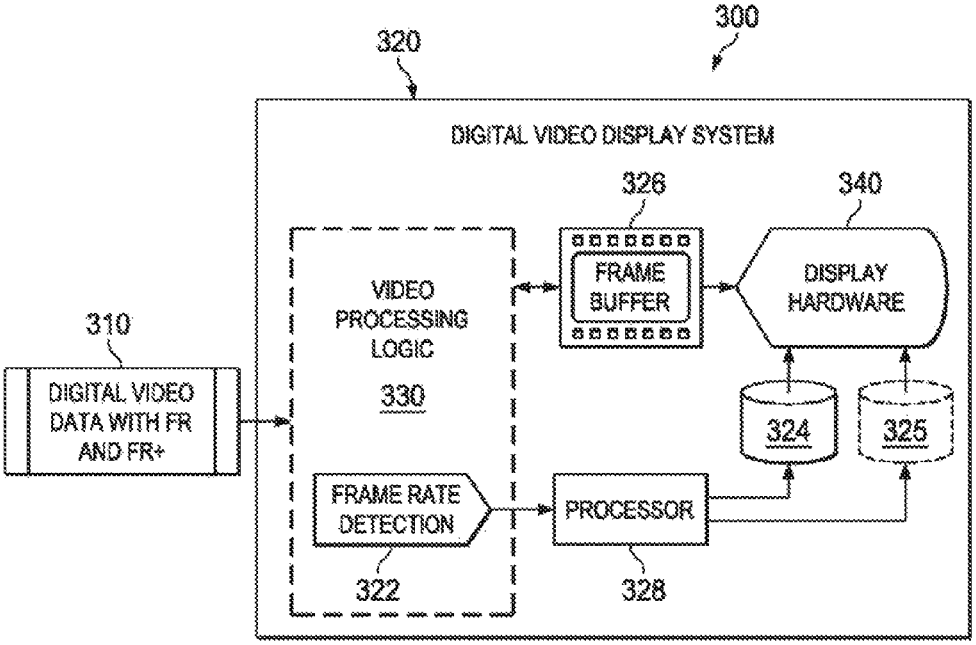
FIG. 2 depicts a block diagram of a video display system incorporating aspects of the present application.

FIG. 2 depicts a block diagram of a video display system incorporating aspects of the present application. In FIG. 2, in system 300 digital video data 310 with frame rate FR and future frame rate FR+ data is presented to a digital video display system 320. Within the digital video display system 320 the digital video data 310 is coupled to video processing logic 330 that includes a frame rate detection block 322. The frame rate detection block 322 is coupled to a processor 328. The video processing logic 330 is coupled to a frame buffer 326. The frame buffer 326 is coupled to the display hardware 340. The processor 328 is coupled to two or more Timing Control Buffers (TCB) 324, 325. The TCB 324, 325 are coupled to the display hardware 340. The frame rate detection block 322 is depicted as a separate block from the processor 328, however in another example arrangement that forms additional aspects of the present application, the frame rate detection could be implemented as a software configuration executed in the processor 328. For example, instructions stored in a memory or within an on-board memory within the processor 328 could cause processor 328 to perform the frame rate detection shown as block 322.

In operation, the frame rate detection block 322 receives digital video data 310 including the frame rate (FR) and future frame rate (FR+) within the data as ancillary (ANC) data and can update the processor 328 with the measured frame rate, the current frame rate data (FR) and the future frame rate data (FR+). The processor 328 can be configured to use the ANC data FR and FR+ to compute the necessary values required by the display hardware 340, and store them in the primary TCB 324 and secondary TCB 325. The data in the frame buffer 326 is displayed on the display hardware 340 using the information stored in TCB 324. If the processor 328 detects a change in frame rate from the previous frame rate, a "swap" event occurs. In this event, TCB 325 becomes the active TCB and the data in the frame buffer 326 is displayed on the display hardware 340 using the information stored in TCB 325. At this point, TCB 325 becomes the primary TCB and TCB 324 becomes the secondary TCB. The ability of the digital video display system 320 to switch to pre-loaded frame rate timing parameters on a specific frame boundary enables the digital video display system to display multiple frame rate video while still reducing or eliminating visual artifacts which otherwise would be seen by the viewer. The image display device can be any display device compatible with digital video data presented in frames, for example, the image display device can be an LED, LCD or plasma TV or monitor, a DLP TV or monitor, an LCD, LCoS or DLP projector, a DLP Cinema® projector, or the like. Illumination sources in the image display device can include laser, laser-phosphor, LED or lamp. Color wheels can be used or alternatively dedicated color illumination sources such as red, green and blue LEDs can be used. One or more spatial light modulators can be used to reflect or transmit the image based on the image data. Digital Micro-Mirror devices (DMDs) can be used as the spatial light modulators. The variable frame rate arrangements of the present application can be used in systems incorporating a variety of display technologies.

Table 1 illustrates a non-limiting example of FR and FR+ data within digital video data 310 assembled from three video sources having frame rates of 24 fps, 60 fps and 96 fps.

TABLE 1

Example Digital Video Data with FR & FR+

| Frame count | Frame Rate | FR data | FR+ data | Note |
|---|---|---|---|---|
| 1 | 24 | 24 | 96 | video start, next frame rate = 96 |
| 2 | 24 | 24 | 96 | Playing, repeats until frame 200 |
| 200 | 96 | 96 | 60 | Rate change, TCB swap |
| 201 | 96 | 96 | 60 | Playing, repeats until frame 300 |
| 300 | 60 | 60 | 24 | Rate change, TCB swap |
| 301 | 60 | 60 | 24 | Playing, repeats until frame 400 |
| 400 | 24 | 24 | 24 | Rate change, TCB swap |
| 401 | 24 | 24 | 24 | No more rate changes in video, repeats until end |
| 500 | 24 | 24 | 24 | End |

In Table 1, the sequence illustrates the display of 500 video frames recorded with variable frame rate information. At frame 1, the current frame rate is shown as 24 fps, with the future frame rate indicated as 96 fps. The frame rate remains at 24 fps for the next 199 frames, then, at frame 200, the current frame rate is changed to 96 fps. The change in the current frame rate field to the previous future frame rate indicates that this frame is the boundary frame, this frame is the first frame to be displayed at the new frame rate (96) and a swap event is indicated at this frame. In Table 1, the frame rate then remains at 96 fps, which is now the current frame rate, with a future frame rate at 60 fps, until frame 300 fps, when the current frame rate is suddenly 60 fps. Again, the change in the current frame rate identifies the frame when the display is to start displaying the frames at 60 fps, and a swap event is indicated. At a swap event, the timing control buffer that is currently being used is swapped with the timing control buffer that contains the future frame configuration. The timing control buffers then change roles, and instantly the display starts displaying the images at the new current frame rate. The timing control buffer that contains the configuration for the previous frame rate is now available to receive the future frame rate configuration.

An aspect of the arrangements of the present application is that the latency of the display system can be accounted for. The future frame rate information is available to the display system well ahead of the switch to displaying at that future frame rate. In this manner, the system can instantly start to display the images at the new frame rate without any frames being displayed at an incorrect frame rate. As a result no artifacts due to the change in frame rate are visible to the viewer. This is in sharp contrast to the prior known systems where the frame rate is detected from the digital video data while the images are already being displayed, thus the images will be incorrectly displayed for a time long enough for the prior system to determine the new frame rate, creating visible artifacts. The arrangements presented herein as aspects of the present application overcome the deficiencies of the prior known approaches.

Table 2 illustrates in one non-limiting example a method of the present application with the encoding of FR and FR+ into a digital video stream 310 using a format that is compatible with the current SMPTE method 291M for providing ancillary data in a video stream.

TABLE 2

Example of encoding FR and FR + 1 via SMPTE 291M

| Row | Name | Value |
|---|---|---|
| 1 | Ancillary Data Flag | 000h, 3FFh, 3FFh, 000h, 3FFh, 3FFh |
| 2 | Data Identification | 140h |
| 3 | Secondary Data Identification | 203h |
| 4 | Data Count | 04h |
| 5 | User Data | Current Frame Time (LSB) |
| 6 | | Current Frame Time (MSB) |
| 7 | | Future Frame Time (LSB) |
| 8 | | Future Frame Time (MSB) |
| 9 | Checksum | Checksum (as specified in SMPTE 291M) |

As shown in Table 2, the current frame rate, and the future frame rate, can be presented as part of the digital video data in a manner compatible with existing standards. In this way the arrangements of the present application for providing variable frame rate information for direct display can be implemented without the need for creating new standards and with existing equipment for producing video content. In alternative arrangements that are also contemplated as additional aspects of the present application, the current frame rate and future frame rate information can be provided in other manners including being embedded in the video data, for example, or being transmitted on a separate communications channel or signal. Table 2 illustrates an arrangement for providing the current frame rate and future frame rate that is compatible with current video standards, but the arrangements of the present application are not limited to this example approach.

Figure 3:
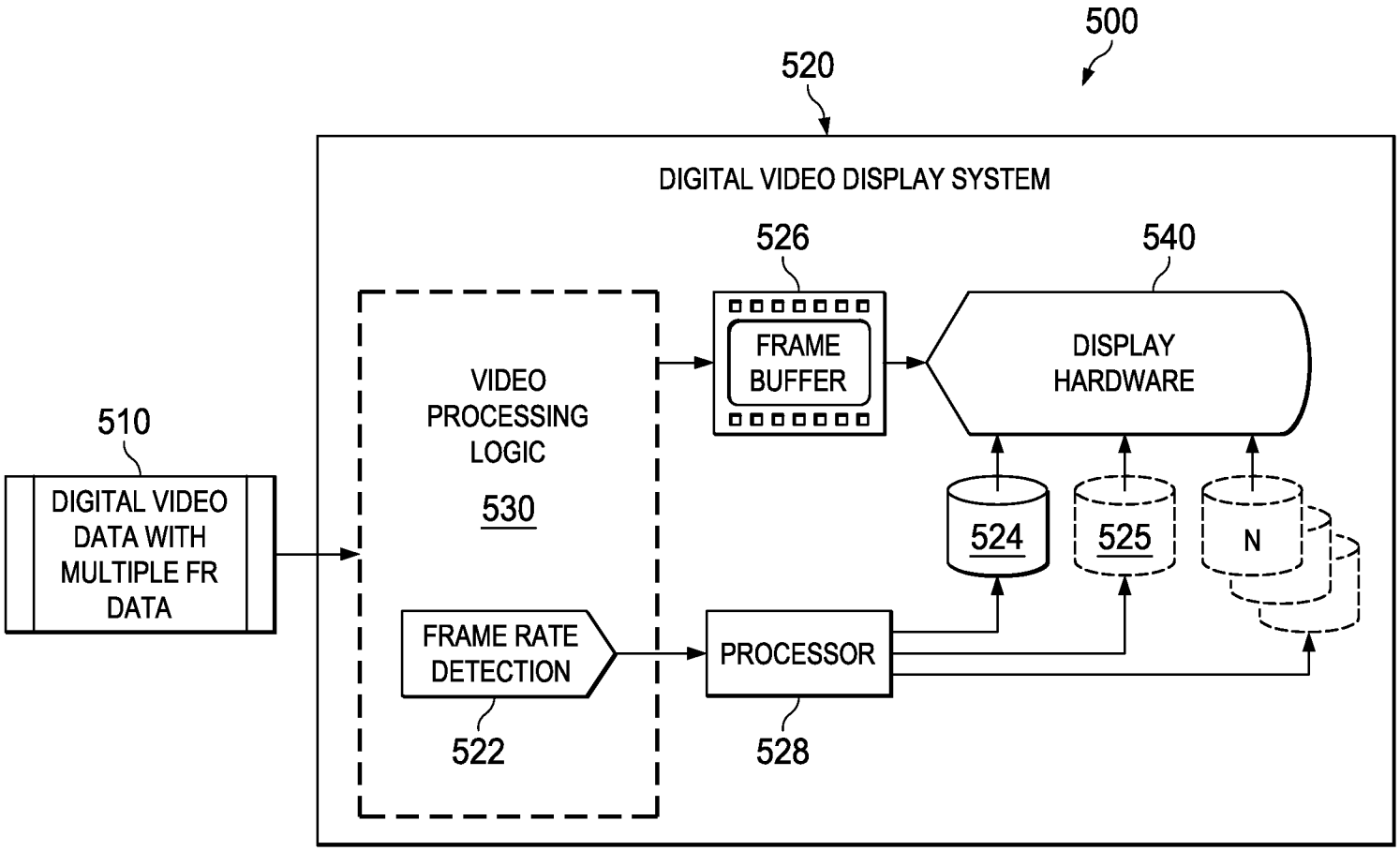
FIG. 3 depicts a block diagram of a video display system incorporating additional aspects of the present application.

FIG. 3 depicts a block diagram of a video display system incorporating aspects of the present application. In FIG. 3, system 500 includes digital video data 510 with current frame rate FR and multiple future frame rates FR++ data that is presented to a digital video display system 520. Within the digital video display system 520 the digital video data 510 is coupled to video processing logic 530 that includes a frame rate detection block 522. The frame rate detection block 522 is coupled to a processor 528. The video processing logic 530 is coupled to a frame buffer 526. The frame buffer 526 is coupled to the display hardware 540. The processor 528 is coupled to Timing Control Buffers (TCB) 524, 525 through N. The TCB 524, 525, through N are coupled to the display hardware 540.

Figure 5:
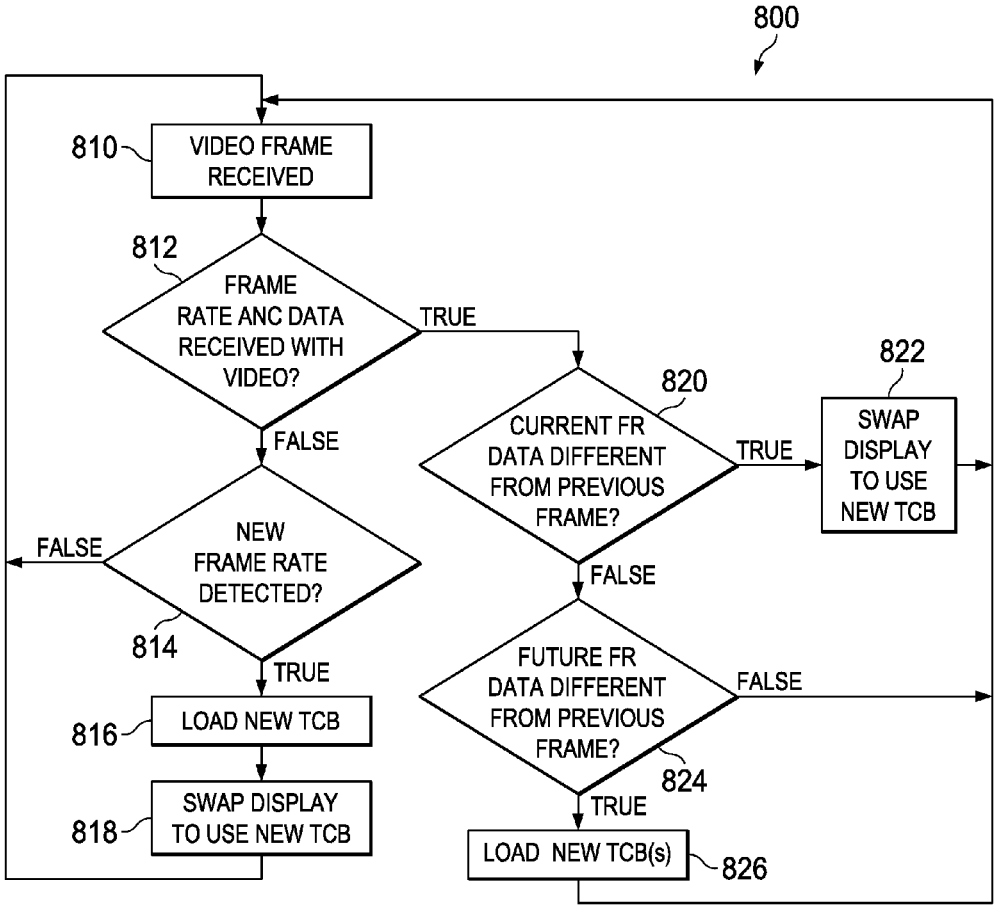
FIG. 5 illustrates in a flowchart a method for displaying produced video content incorporating aspects of the present application.

In operation, the frame rate detection block 522 receives digital video data 510 including the frame rate (FR) and multiple future frame rates (FR++) within the data as ancillary (ANC) data and can update the processor 528 with the measured frame rate, the current frame rate data (FR) and the future frame rate data (FR++). The processor 528 can be configured to use the ANC data FR and FR++ to compute the necessary values required by the display hardware 540, and store them in the primary TCB 524, the secondary TCB 525 and any other TCBs through N. The data in the frame buffer 526 is displayed using the information in TCB 524. If the processor 528 detects a change in frame rate from the previous frame rate, an "index" event occurs. In this event, the processor 528 identifies a TCB, 525 through N, to be active and the data in the frame buffer 526 will be displayed using the information in the current active TCB. The ability of the digital video display system 520 to switch to preloaded timing parameters on a frame boundary enables the digital video display system 520 to directly display video content with varying frame rates while reducing or eliminating visual artifacts which otherwise may be seen by the viewer. In the arrangement of FIG. 5, a variety of N timing control buffers 524, 525-N are provided, each containing parameters required to display images at a different frame rate. In this manner the future frame rate data is stored in a buffer for each of the supported frame rates, enabling the image display device to instantly change to any of the supported frame rates on a specific frame boundary and to instantly display the images at the multiple frame rates without visible artifacts appearing due to the frame rate change.

Figure 4:
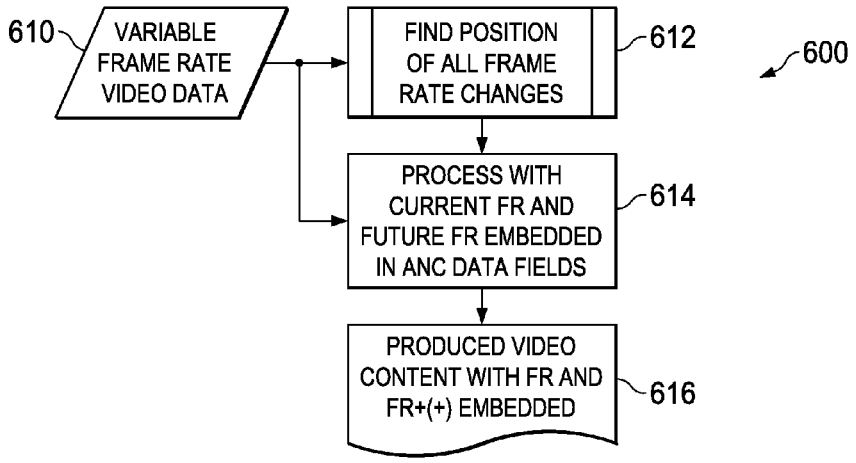
FIG. 4 illustrates in a flowchart a method for creating variable frame rate produced video content incorporating aspects of the present application.

FIG. 4 illustrates in a flowchart a method for creating variable frame rate produced video content incorporating aspects of the present application. The method 600 begins at step 610, "Variable Frame Rate Video Data". At step 612, the method finds position information for all variable frame rate changes. At step 614, the method continues by processing the digital video data to embed the ancillary data ANC with the current frame rate FR and the future frame rate(s) FR+(+) embedded in at least some of the digital video data. In one example arrangement, ancillary data is provided for each frame of digital video data. In another alternative example arrangement, at least some of the video frames include ancillary data, while between new frames that include ancillary data, the system can continue using the last frame rate update as the variable frame rate information. At step 616 the Produced Content is provided including the current frame rate and the future frame rate information embedded within it.

An important feature of the arrangements of the present application is that the system latency in making frame changes can be accounted for. Because the ancillary data enables the transmission of the future frame rate information for many frames prior to the "swap" event, the system can easily store the configuration data needed to make the variable frame rate switch on a frame boundary. In this manner the system is able to instantly switch to the new frame rate on the selected frame boundary and the arrangements described above also enable an easy detection of the particular frame where the produced content begins at the new frame rate. Visible artifacts will not be displayed as the system changes frame rates when the various arrangements of the present application are utilized. The video content can be produced at high frame rates when the content includes fast motion, while slower changing content can be produced at slower frame rates. The use of the arrangements described above thus enables an optimization of the video content for frame rate, selection of the appropriate frame rate for the content being displayed at a particular moment in the video content can be made and the frame rate can be dynamically changed while the image displayed is yet free from visible artifacts.

FIG. 5 illustrates in a flowchart a method to display variable frame rate produced video content incorporating additional aspects of the present application. The method 800 starts at step 810, "Video Frame Received", waiting for the next frame of video data. When video data is received, it is tested in step 812 to see if it contains ancillary data (ANC) that contains frame rate information. If the condition is false, testing continues at step 814 where the frame rate is measured and compared to the previously measured rate. If the new frame rate is the same as the previous, then processing returns to step 810 waiting for the next frame of video data. If the new frame rate is not the same as the previous, then values for a new TCB are generated and a new TCB is loaded in step 816. Once the new TCB is loaded, the display hardware is told to "swap" and start using the new TCB in step 818, and the processing returns to step 810 waiting for the next frame of video data. If this condition in step 812 is true, then the current frame rate in the ancillary data is compared to the current frame rate received in previous frames to see if they differ in step 820. If this condition is true, the current frame rate for this frame is different than the previous current frame rate, then the display hardware is told to "swap" and start using a new TCB that had been previously loaded in step 822. Processing then returns to step 810 waiting for the next frame of video data. If the current frame rate for this frame is not different (it is the same) as the previous current frame rate, then the future frame rate(s) data is compared to the future frame rate(s) from the previously received frame to see if they differ in step 824. If this condition is true, the future frame rate(s) for this frame is/are different than the previous future frame rate(s), then values for new TCB(s) are generated and new TCB(s) are loaded in step 826. Processing then returns to step 810 waiting for the next frame of video data.

A feature of the present application relates to step 824 where multiple future frame data may be embedded in the digital video stream. Having more than 1 future frame rate allows for transitions between frame rates so frequently that only having a single future frame rate would not be sufficient to get the timing control buffer (TCB) filled before the transition. While having a single duplicate timing control buffer allows for a "swap" between buffers, having 3 or more buffers would call for an "index" to point to a specific timing control buffer. However the index is an alternative arrangement and the present application is not limited to this arrangement, a two buffer system can also be used with a simple swap between them as is described above.

Various modifications can also be made in the order of steps and in the number of steps to form additional novel arrangements that incorporate aspects of the present application, and these modifications will form additional alternative arrangements that are contemplated by the inventor as part of the present application and which fall within the scope of the appended claims.

Although the example illustrative arrangements have been described in detail, it should be understood that various changes, substitutions and alterations can be made herein without departing from the spirit and scope of the present application as defined by the appended claims.

Moreover, the scope of the present application is not intended to be limited to the particular illustrative example arrangement of the process, machine, manufacture, and composition of matter means, methods and steps described in this specification. As one of ordinary skill in the art will readily appreciate from the disclosure, processes, machines, manufacture, compositions of matter, means, methods or steps, presently existing or later to be developed, that perform substantially the same function or achieve substantially the same result as the corresponding example arrangements described herein may be utilized according to the illustrative arrangements presented and alternative arrangements described, suggested or disclosed. Accordingly, the appended claims are intended to include within their scope such processes, machines, manufacture, compositions of matter, means, methods, or steps.

What is claimed is:

1. Apparatus comprising:

a first timing control buffer to store a first set of timing parameters for displaying images at a first frame rate;

a second timing control buffer to store a second set of timing parameters for displaying images at a second frame rate;

a frame buffer to store image data;

display hardware, coupled to the frame buffer and the first and second timing control buffers, to display images in response to: the frame buffer's stored image data; and a selected one of the first and second sets of timing parameters; and video processing logic, coupled to the frame buffer and the first and second timing control buffers, to: receive digital video data that includes at least ancillary data and the image data, wherein the ancillary data includes at least a current frame rate and a future frame rate; write the received image data into the frame buffer for storage; in response to the current frame rate being equal to the first frame rate, select the first set of timing parameters in the first timing control buffer as the selected set for the display hardware to display images; in response to the current frame rate being equal to the second frame rate, select the second set of timing parameters in the second timing control buffer as the selected set for the display hardware to display images; if the selected set is the first set of timing parameters, update the second set of timing parameters in the second timing control buffer for causing the second frame rate to be equal to the future frame rate; and, if the selected set is the second set of timing parameters, update the first set of timing parameters in the first timing control buffer for causing the first frame rate to be equal to the future frame rate.

2. The apparatus of claim 1, wherein the video processing logic comprises:

a frame rate detect circuit, responsive to the ancillary data, to: detect a change in the current frame rate; and output a signal in response to detecting the change.

3. The apparatus of claim 2, further comprising:

circuitry to selectively couple, responsive to the signal, either: the first set of timing parameters in the first timing control buffer to the display hardware, so the first set of timing parameters is the selected set for the display hardware to display images; or the second set of timing parameters in the second timing control buffer to the display hardware, so the second set of timing parameters is the selected set for the display hardware to display images.

4. The apparatus of claim 3, wherein the detected change in the current frame rate is a change from the current frame rate to a previously received future frame rate.

5. The apparatus of claim 1, wherein changing the selected set for the display hardware to display images does not visibly affect the displayed images.

6. The apparatus of claim 1, wherein the ancillary data is embedded within a non-displayable portion of the digital video data.

7. The apparatus of claim 6, wherein the ancillary data is embedded within a non-displayable portion of an image frame of the digital video data.

8. The apparatus of claim 1, wherein the display hardware is configured to display images at frame rates that include at least two selected from a group consisting essentially of 24, 30, 48, 50, 60, 84, 90, 96, 100, 120, 144, 240, and 300 frames per second.

9. The apparatus of claim 1, wherein the display hardware is configured to display images at a first frame rate of at least 24 frames per second and at a greater second frame rate.

10. A method, comprising:

in a first timing control buffer, storing a first set of timing parameters for displaying images at a first frame rate;

in a second timing control buffer, storing a second set of timing parameters for displaying images at a second frame rate;

receiving digital video data that includes at least ancillary data and image data, wherein the ancillary data includes at least a current frame rate and a future frame rate;

writing the received image data into a frame buffer for storage;

with display hardware, displaying images in response to: the frame buffer's stored image data; and a selected one of the first and second sets of timing parameters;

in response to the current frame rate being equal to the first frame rate, selecting the first set of timing parameters in the first timing control buffer as the selected set for the display hardware to display images;

in response to the current frame rate being equal to the second frame rate, selecting the second set of timing parameters in the second timing control buffer as the selected set for the display hardware to display images;

if the selected set is the first set of timing parameters, updating the second set of timing parameters in the second timing control buffer for causing the second frame rate to be equal to the future frame rate; and if the selected set is the second set of timing parameters, updating the first set of timing parameters in the first timing control buffer for causing the first frame rate to be equal to the future frame rate.

11. The method of claim 10, wherein changing the selected set for the display hardware to display images does not visibly affect the displayed images.

12. The method of claim 10, further comprising:

in response to the ancillary data, detecting a change in the current frame rate, and outputting a signal in response to detecting the change.

13. The method of claim 12, further comprising:

in response to the signal, selectively coupling either: the first set of timing parameters in the first timing control buffer to the display hardware, so the first set of timing parameters is the selected set for the display hardware to display images; or the second set of timing parameters in the second timing control buffer to the display hardware, so the second set of timing parameters is the selected set for the display hardware to display images.

14. The method of claim 13, wherein the detected change in the current frame rate is a change from the current frame rate to a previously received future frame rate.

15. The method of claim 10, wherein the ancillary data is embedded within a non-displayable portion of the digital video data.

16. The method of claim 15, wherein the ancillary data is embedded within a non-displayable portion of an image frame of the digital video data.

* * * * *